United States Patent [19]

Ochs

[11] Patent Number: 4,852,753

[45] Date of Patent: Aug. 1, 1989

[54] CLOSURE CAP AND THIN WALLED CONTAINER

[75] Inventor: Charles S. Ochs, Lancaster, Ohio

[73] Assignee: Anchor Hocking Corporation, Lancaster, Ohio

[21] Appl. No.: 231,371

[22] Filed: Aug. 11, 1988

Related U.S. Application Data

[62] Division of Ser. No. 48,560, May 11, 1987, abandoned, which is a division of Ser. No. 839,557, Mar. 14, 1986.

[51] Int. Cl.[4] ..... B65D 41/04

[52] U.S. Cl. ..... 215/271

[58] Field of Search ..... 215/271, 260, 228, 365

[56] References Cited

U.S. PATENT DOCUMENTS 2,194,004 3/1940 Bukolt ..... 215/271

3,189,210 6/1965 Heisler ..... 215/260

*Primary Examiner*—Donald F. Norton

*Attorney, Agent, or Firm*—Stoll, Hoffman & Previto

[57] ABSTRACT

A closure cap is disclosed for sealing containers and particularly for sealing thin-walled vacuum formed containers with threaded rims. The closure cap is a composite closure having a molded plastic ring for engaging the container and for mounting a disc-like metal cover. The metal cover includes a vacuum indicating disc particularly adapted for providing a positive indication for relatively low vacuums and the closure cap is adapted for being sealed onto the container with a combination of press-on and screwing action to provide for high speed vacuum sealing. The vacuum indicating action of the vacuum button is improved by providing a channel in the plastic ring at the edge of the metal cover for stablizing the button operation at the desired low vacuum levels.

1 Claim, 3 Drawing Sheets

Fig. 1.
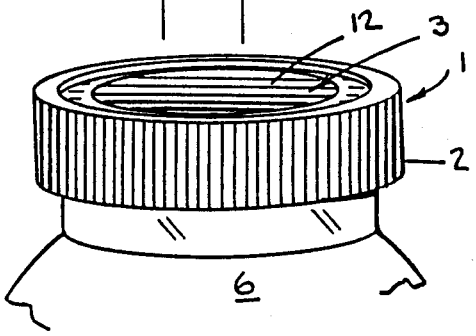
Fig. 2.
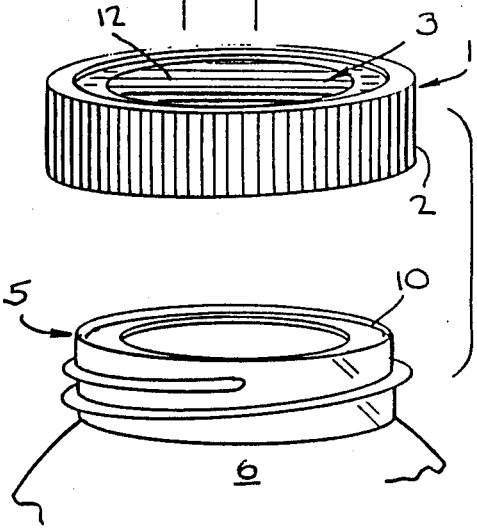
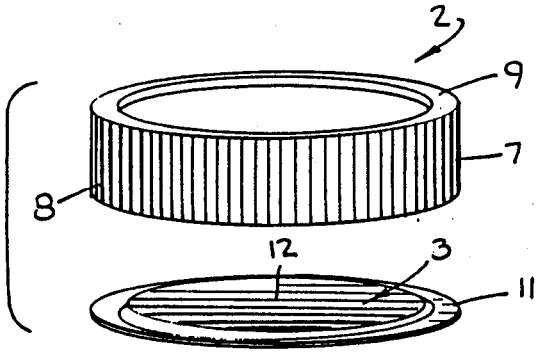
Fig. 3.
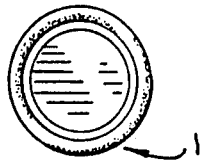
Fig. 4.
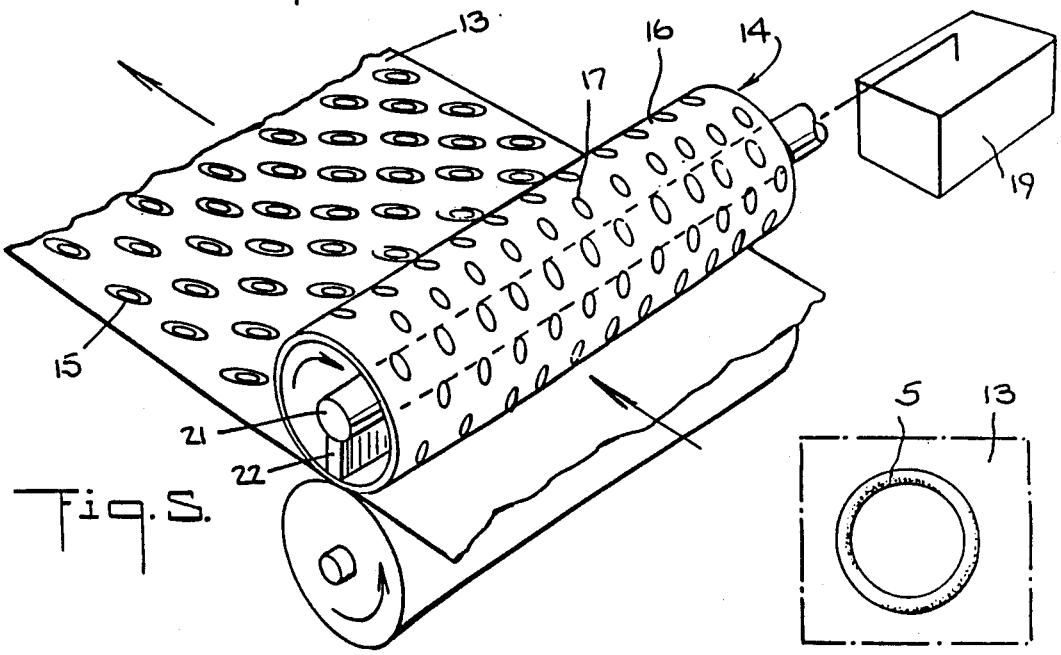
Fig. 5.
Fig. 6.

CLOSURE CAP AND THIN WALLED CONTAINER

This is a division of application Ser. No. 048,560 filed May 11, 1987, now abandoned and itself a division of Ser. No. 839,557 filed on Mar. 14, 1986.

BACKGROUND OF THE INVENTION

The present invention relates to an improved composite closure cap of the type used for sealing containers and particularly plastic containers. More particularly, the invention relates to a composite closure which is especially useful for sealing plastic containers which have been formed by molding or vacuum forming methods.

Many products, and particularly many food products, have been traditionally packaged in glass or metal containers which are relatively expensive as well as often being relatively heavy. More recently there has been a development of other types of containers and one such container comprises a relatively thin plastic container which is either molded or vacuum formed. These containers are characterized by extremely thin walls and light weight so that they present a number of different problems related to their sealing with closure caps. The closure cap and the related package finish of the invention are particularly useful on these thin wall plastic containers. The closures are not only characterized by their ability to provide an easily formed and effective seal, but also by their ease of manufacture and their ability to provide a vacuum indicator where the closures are used in vacuum sealing processes.

The closure cap of this invention and the related container finish are particularly useful upon inexpensive food packaging such as baby food packaging where the products are distributed in millions of packages per day requiring a simply manufactured and easily filled and sealed package. In addition, the closure cap is useful for baby food products where the user has occasion to open and then re-seal the package.

It is characteristic in vacuum sealng these thin-walled plastic containers to use a lesser vacuum than has been traditionally used with the glass and other thicker walled containers and the closure cap of the invention provides an effective vacuum indication even with a relatively low vacuum.

Another advantage present in packages of the invention sealed with the improved closure cap is the ability of the sealed packages to provide vacuum indication during an exposure of the sealed package to pressure changes, including those experienced where packages are transported through or to high altitude locations.

Accordingly, an object of the present invention is to provide an improved closure cap and sealing finish for a plastic package.

Another object of the present invention is to provide a closure cap particularly adapted for sealing thin-walled plastic containers.

Another object of the present invention is to provide an improved gasket and method of manufacture for a closure cap.

Another object of the present invention is to provide an improved cooperating container finish and closure cap for being applied thereto, particularly for thin walled plastic containers.

Other and further objects of the present invention will become apparent upon an understanding of the illustrative embodiments about to be described, or will be indicated in the appended claims and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIGS. 1 and 2 are perspective views of the closure cap and the container finish illustrated in the sealed and unsealed positions.

FIG. 3 is a perspective exploded view illustrating composite closure cap with its plastic outer ring and separate cover portions.

FIG. 4 is a top plan view of a closure cap in accordance with the invention.

FIG. 5 is a diagrammatic illustration of improved means for applying the closure gasket in accordance with the present invnetion.

FIG. 6 is an enlarged top plan view of a gasket as applied to sheet material in accordance with the method of the invention.

DESCRIPTION OF THE PREFERRED EMBODIMENT

Figure 7:
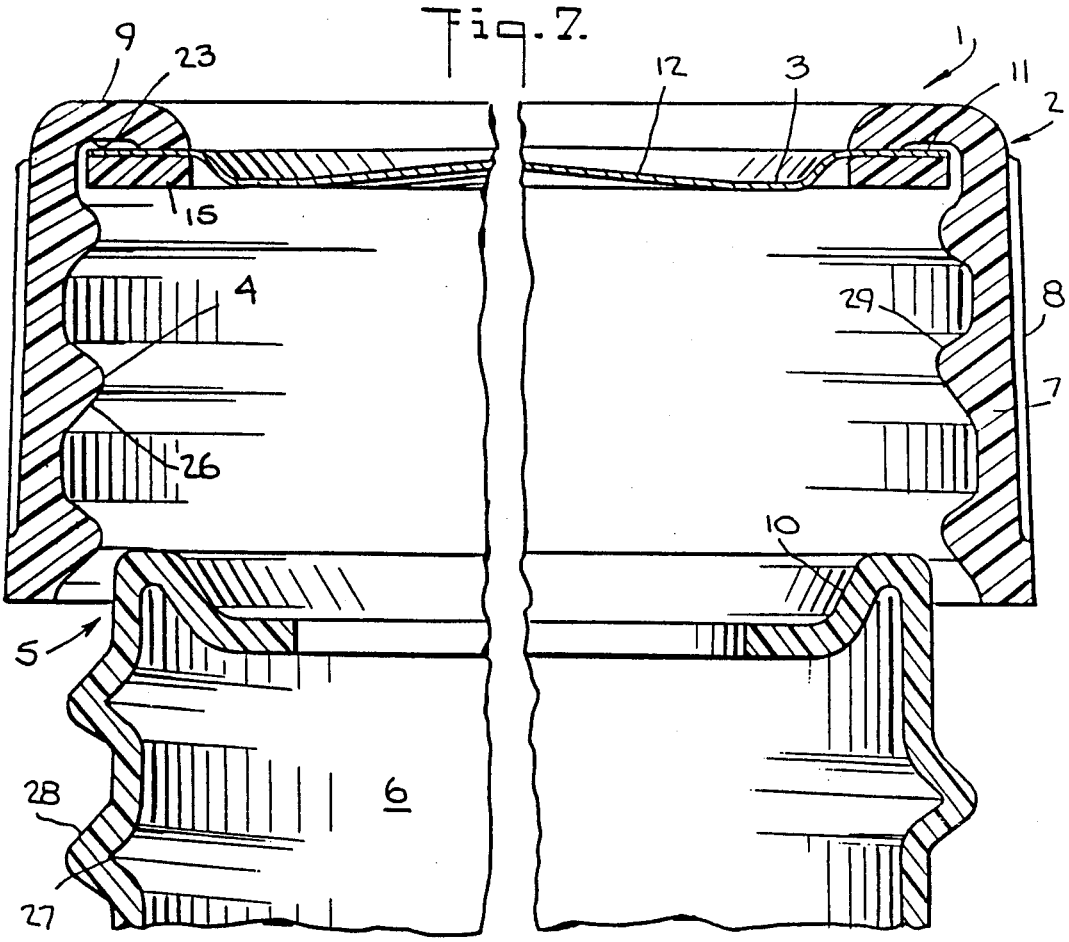
FIGS. 7 and 8 are vertical sectional views of one preferred embodiment of the closure cap and the package finish in the unsealed and sealed positions respectively.

FIGS. 1 thru 4 illustrate a preferred embodiment of the composite closure cap with a preferred container finish in accordance with the present invention. The composite cap 1 comprises an outer molded plastic ring or fitment 2 which receives a disc-like cover 3. As will be more fully described below, the fitment 2 includes container engaging threads 4 (FIG. 7) and the cover 3 includes an annular sealing gasket encircling the outer edge and container engaging portion of the cover 3.

Figure 8:
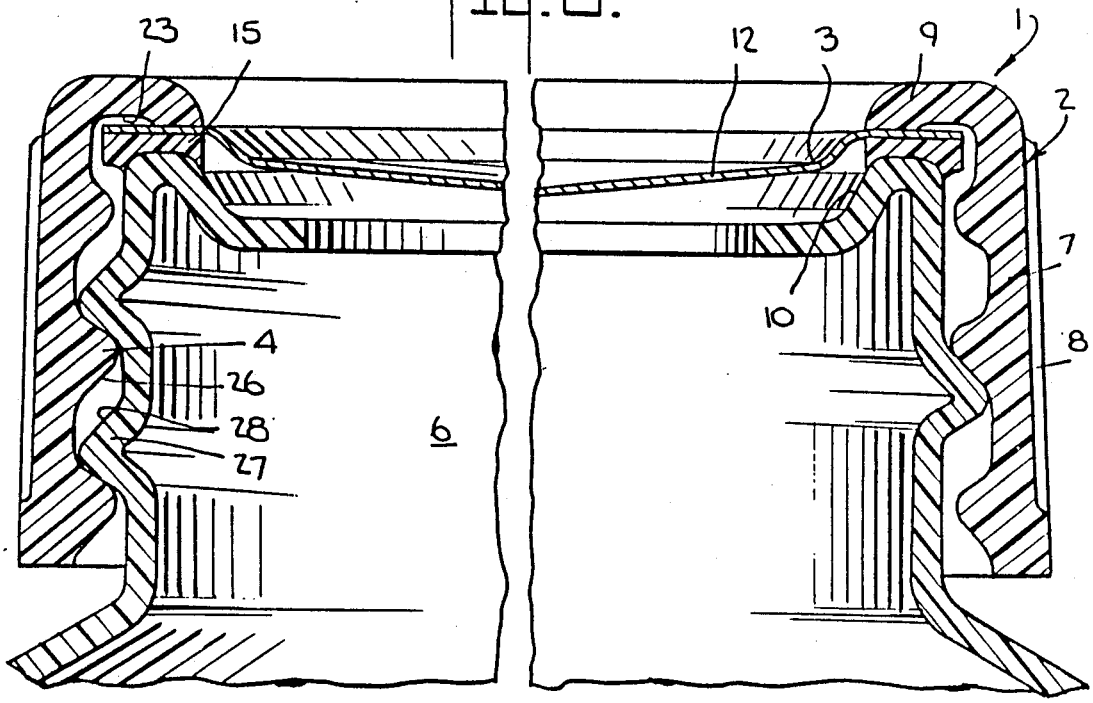

FIGS. 7 and 8 illustrate in detail the preferred shaping of one embodiment of the closure cap 1 and container finish 5 illustrated more generally in FIGS. 1 thru 4 and FIGS. 9 and 10 illustrate another embodiment.

The closure cap 1 of the invention and the container finish 5 will be described in connection with a thin-walled plastic container 6 formed by the well known vacuum forming processes wherein thin sheets of plastic are shaped by vacuum forces over suitable forming molds. This method of forming articles such as hollow containers is well adapted to provide a precisely shaped finish at the container rim for engaging the sealing closure. The preferred closures 1 and the preferred sealing finishes 5 are also useful on containers of the same general shape provided by other container forming methods such as a blow molding or other container forming process.

As illustrated in FIGS. 7 and 8, one preferred closure cap 1 in accordance with the present invention, comprises a plastic fitment 2 including a closure skirt 7 with container engaging threads 4 formed on the interior of the skirt 7 and with suitable gripping knurls 8 provided on the fitment outer surface. The plastic fitment 2 comprises an annular cover engaging portion 9 extending inwardly from the top of the skirt 7 a sufficient distance to cover the upwardly facing rim 10 of the container 6.

The cover 3 comprises a relatively flat outer ring-like gasket receiving portion 11 and a domed central portion comprising a vacuum indicating button 12 formed into the material of the cover 3.

A preferred method of providing a gasket on the disc-like cover 3 is illustrated in FIGS. 5 and 6. In accordance with this method, sheet material 13 of the appropriate thickness is passed through a rotary screen coating apparatus 14.

FIGS. 5 and 6 illustrate the method of forming the sealing gaskets using a rotary screen coating apparatus 14 which is applying gaskets 15 with the appropriate spacing on the sheets of tin plate 13 for subsequent blanking and forming operations to produce the individual closure cap covers 3. This apparatus includes the rotary screen 16 having ring-like apertures 17 cut in its surface for transferring the plastisol or other suitable gasket material to the sheet material. The plastic material is fed by a suitable pump from a plastic reservoir 19 and passes through an elongated feed nozzle 21 positioned within the rotary screen 16. A squeeze blade 22 positioned below the nozzle 21 forces the plastic material onto the surface of the sheet material 13. By this method the gaskets 15 are rapidly formed in the appropriate position on the sheet material 13 and the sheet material 13 is presented to the stamping and forming machines with the gaskets already in position.

A suitable thickness for a gasket is printed in accordance with this invention and is from 0.01 to 0.04 inches. The screens 16 are typically metal such as nickel. Differing screen mesh sizes are usefully employed and best results have been found to be obtained as far as gasket shapes and gasket thickness for 59 mesh screens although mesh openings per lineal inch may run between about 16 and 83.

Figure 9:
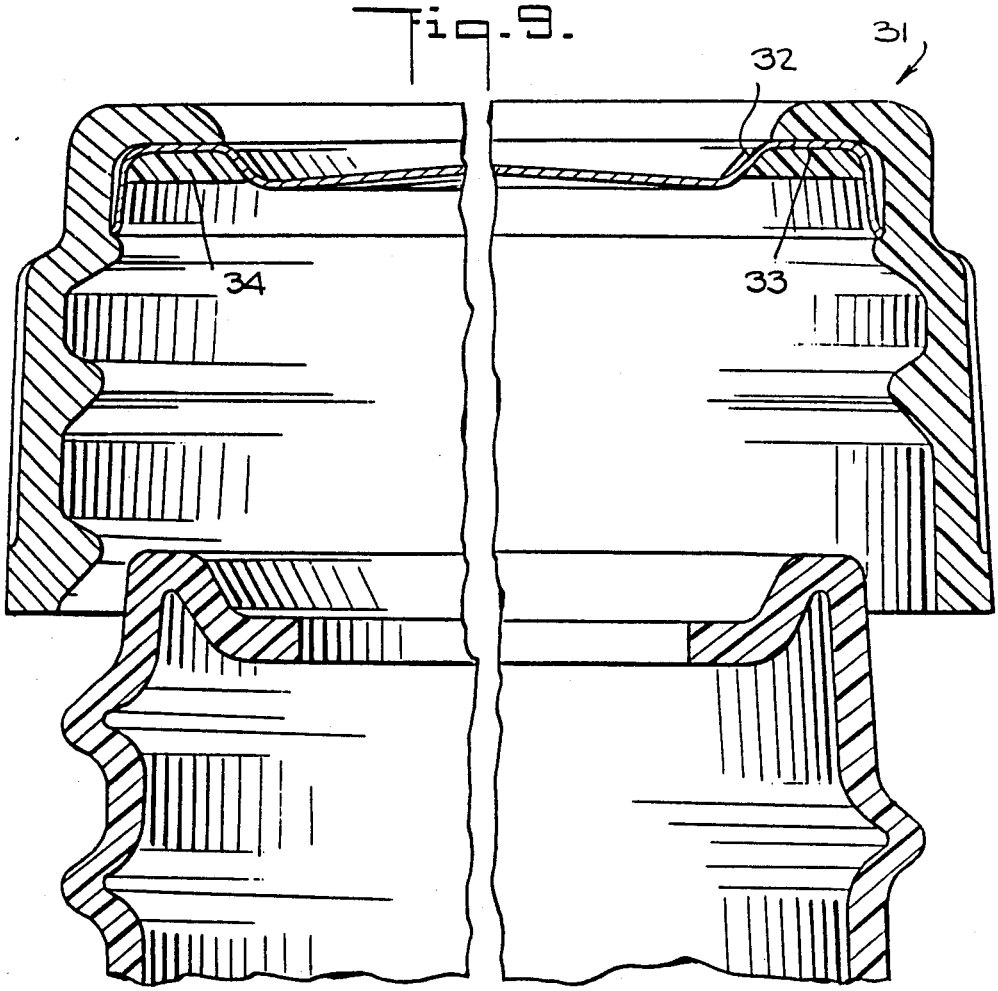
FIGS. 9 and 10 are vertical sectional views of another embodiment of the closure cap and container finish illustrated in their unsealed and sealed positions respectively.
Figure 10:
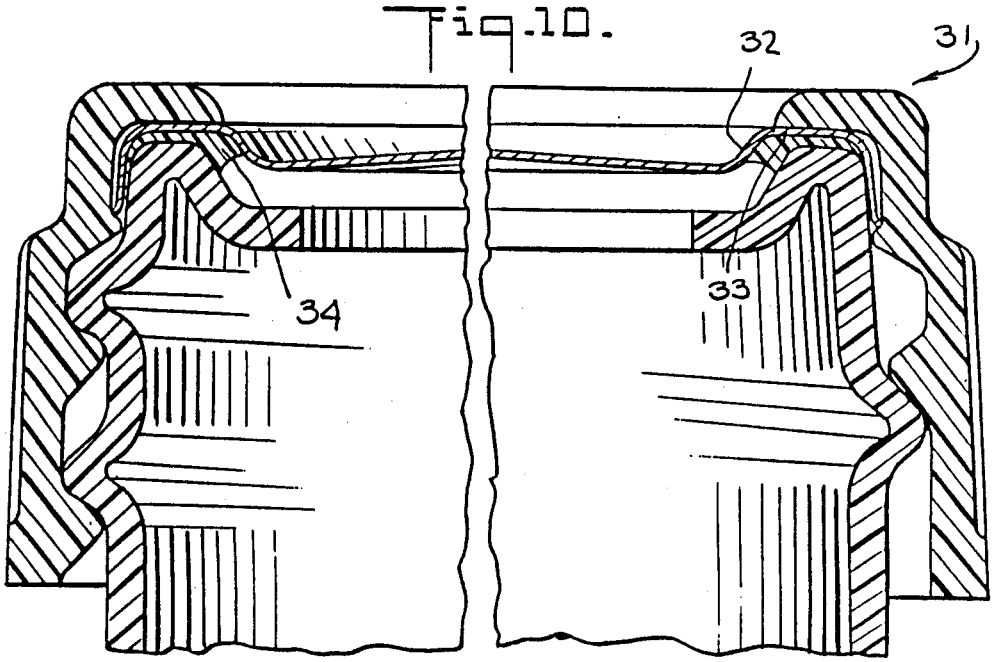

For the printed gaskets 15 various plastisol compounds are useful, however, significantly improved results have been obtained with relatively high viscosity plastisols. For flowed-in gaskets as illustrated in FIGS. 9 and 10 the conventional plastisol gasket formulations are satisfactory.

The closure cap and finish illustrated generally in FIGS. 1 thru 4 may employ the gasket 15 of this type on the covers illustrated in detail in the sectional views of FIGS. 7 and 8. Thus, after the application of the gaskets 15 to the sheets 13, they are blanked and formed to the disc-like covers with the gaskets 15 at the outer edge of the cover and with a domed vacuum indicator 12 formed in the central portion of the cover 3 extending inwardly from a recessed shoulder. The flat edges on the covers 3 at the gaskets 15 are relatively flexible, as contrasted with covers 32 (FIG. 9), and this cover flexibility provides excellent abuse resistance as, for example, when the packages 6 are squeezed.

The vacuum button 12 is shaped to provide a sensitive vacuum indicating movement from a depressed position under vacuum to the normal raised position of the button as illustrated in FIG. 7. FIG. 8 illustrates the vacuum button 12 in its sealed position on a vacuum packed product.

In order to provide for a predictable and constant vacuum button 12 action independently of the sealing forces on the cover 3 edges, the preferred plastic ring 2 for the closure cap of FIG. 7 has a downwardly facing channel 23 formed in the cover portion 10 of the plastic ring 2 and positioned at the outer edge of the cover 3 in the sealed position illustrated in FIG. 8.

In order to facilitate the sealing of threaded closure caps such as the embodiment of the cap 1 illustrated in FIG. 7, it is desirable to permit at least a portion of the cap application to be performed with a press-on action to force the caps 1 directly downwardly onto the container threads and to thus limit the more complicated rotary sealing action to only a finally fractional turn of the closure cap 1 on the container 9. This sealing characteristic is provided in the closure cap of FIGS. 7 and 8 by forming steeply inclined surfaces 26 on the undersides of the container engaging threads 4 on the cap skirt 7. These surfaces which have an angle with the horizontal of 45° or more thus pass easily over the container threads 27. To further facilitate this action, the upper surfaces 28 of the container threads 27 are similarly steeply slanted to have an angle and cross-section of 45° or greater with the horizontal. These skirt and thread shapes in combination with the slight compressability with the thin-walled plastic package readily provide the desired result of a full or partial press-on sealing capability. The upwardly facing surfaces 29 on the closure cap threads 4 and the downwardly facing surfaces 30 on the container threads 27 are provided with a less suitably inclined surface of about 30° or less to assure the retention of the seal after the closure cap 1 has been applied. While the cover 3 is conveniently formed of metal plate, it may also be formed with similar steps with composite sheets of suitable non-metallic materials.

The container 6 illustrated in FIGS. 7 and 8 has a suitable sealing rim formed to provide a top, and edge seal with the cover gasket 15 in the manner illustrated in FIG. 8 and with the desired amount of rigidity being provided at the container rim by the inwardly extending rim flange portion 10.

FIGS. 9 and 10 illustrate at 31 another embodiment of the closure cap where the cap cover 32 is formed with a gasket receiving channel 33 at its outer edge for receiving a flowed-in plastisol gasket 34 to form the package seal as illustrated in FIG. 10. This embodiment of the cap is illustrated with cap and container threads lacking the steeply slanted surfaces described in connection with threads of FIGS. 7 and 8, but may employ such threads if desired, as well as the pressure relief channels such as channel 23 described in connection with the closure cap of FIG. 7.

It will be seen that an improved closure cap and container finish have been described for use with volume produced packaging for products such as baby foods and others. The closure is particularly useful for high speed sealing for providing high use sealed packages and for permitting sealed containers to be opened and reclosed. A composite closure cap in accordance with the invention, as described above, is particularly useful on thin-walled plastic containers such as are formed by vacuum forming processes.

As various changes may be made in the form, construction and arrangement of the invention and without departing from the spirit and scope of the invention, and without sacrificing any of its advantages, it is to be understood that all matter herein is to be interpreted as illustrative and not in a limiting sense.

Having thus described my invention, I claim:

1. An improved package comprising a thin walled container sealed with a composite closure including a vacuum indicator button, said thin walled container being adapted to expand under reduced atmospheric pressure to maintain the same relative pressure difference on the vacuum indicating button thereby keeping it depressed to indicate a good seal while the package is at a place of reduced atmospheric pressure.

* * * * *